US008506765B2

(12) United States Patent
Benham

(10) Patent No.: US 8,506,765 B2
(45) Date of Patent: Aug. 13, 2013

(54) DEVICE AND METHOD FOR THERMAL DECOMPOSITION OF ORGANIC MATERIALS

(76) Inventor: Roger A. Benham, San Diego, CA (US)

( * ) Notice: Subject to any disclaimer, the term of this patent is extended or adjusted under 35 U.S.C. 154(b) by 870 days.

(21) Appl. No.: 12/654,468

(22) Filed: Dec. 22, 2009

(65) Prior Publication Data

US 2010/0155216 A1 Jun. 24, 2010

Related U.S. Application Data

(60) Provisional application No. 61/193,775, filed on Dec. 23, 2008.

(51) Int. Cl.
*C10B 1/00* (2006.01)
*C10J 3/57* (2006.01)

(52) U.S. Cl.
USPC ..... 202/219; 48/92; 196/118; 201/11; 432/197

(58) Field of Classification Search
USPC ..... 202/219, 96, 99, 108, 208, 262; 201/10, 201/11; 48/92; 196/118; 208/404, 405; 423/DIG. 12; 588/314; 432/197; 422/187, 422/198
See application file for complete search history.

(56) References Cited

U.S. PATENT DOCUMENTS

| | | | | | |
|---|---|---|---|---|---|
| 1,734,970 | A | * | 11/1929 | Jenson | 208/404 |
| 2,730,488 | A | * | 1/1956 | De Rosset et al. | 208/125 |
| 3,718,708 | A | * | 2/1973 | Ozawa et al. | 585/634 |
| 3,890,908 | A | * | 6/1975 | von Klenck et al. | 110/243 |
| 3,977,960 | A | * | 8/1976 | Stout | 208/404 |
| 5,085,738 | A | * | 2/1992 | Harris et al. | 201/11 |
| 5,693,188 | A | * | 12/1997 | Donnohue et al. | 202/118 |
| 2007/0289509 | A1 | | 12/2007 | Vera | |
| 2008/0307703 | A1 | | 12/2008 | Dietenberger | |

* cited by examiner

*Primary Examiner* — Jill Warden
*Assistant Examiner* — Joye L Woodard
(74) *Attorney, Agent, or Firm* — Welsh Flaxman & Gitler LLC

(57) ABSTRACT

An apparatus for thermally decomposing organic feedstock material utilizing a series of connected vessels. Each of the vessels is provided with an inlet and an outlet for transferring the organic feedstock material between the vessels. Separate heat exchangers are located between the inlet and outlet of each vessel. A catalyst material, such as a permeable mesh, is included between the inlet and outlet of each vessel to accelerate liquefaction of gaseous hydrocarbons.

18 Claims, 5 Drawing Sheets

DEVICE AND METHOD FOR THERMAL DECOMPOSITION OF ORGANIC MATERIALS

CROSS-REFERENCE TO RELATED APPLICATION(S)

The present invention claims the priority of U.S. Provisional Patent Application Ser. No. 61/193,775, filed on Dec. 23, 2008, and is incorporated herein by reference.

FIELD OF THE INVENTION

The present invention relates to means of thermally decomposing organic material feedstocks to dispose of organic and inorganic waste streams, produce energy, produce combustible fuels, produce usable materials, and promote the ability to sequester carbon. The material feedstock materials could come from municipal or industrial waste streams, produce from agriculture operations, or from mining operations such as coal or shale. The present invention provides superior temperature control and heat transfer characteristics and enables novel and unique means of heat exchange between endothermic and exothermic reactions in the process stream. This invention provides a sort of "fractional distillation" arrangement enabling the opportunistic capture of gaseous and liquid hydrocarbon fuel components, contaminants, and selected organic or inorganic species or components of the feedstock material.

BACKGROUND OF THE INVENTION

Many thermal decomposition methods and apparatus exist, such as the following U.S. published patent applications:

| | |
|---|---|
| US 2008/0307703 A1 | Dietenberger |
| US 2007/0289509 A1 | Vera |

The abovementioned thermal decomposition designs have their benefits and shortcomings. The present invention is designed to create an improved thermal decomposition device to help overcome the disadvantages of the existing art. Some benefits include:

- "Fractional" separation arrangement where the process can be taken from lower temperature (say 250 Degrees F., for drying wet organic feedstocks and steam production), to medium temperatures (say 500-900 degrees F., for separation of naturally occurring oils and fats), to higher temperatures (say 900-1800 degrees F., for gasification of organic matter into "syngas" and production of "char"), all within a single reaction vessel.
- Lower temperature process increases safety aspects of process
- Lower temperature process requires less expensive materials and lessons requirements for insulating materials.
- "Fractional" separation arrangement where the process can be taken through varying temperatures, say from lower temperatures (say 250 degrees F. for separation of moisture from wet organic feedstocks and stream production) to higher temperatures (say 1,800 degrees F. for development of "char" and inorganic products).
- "Fractional" separation arrangement where the process can be taken through varying pressures, say from higher pressures (say 150 psi for separation and processing of moisture from wet organic feedstocks for steam production) to lower pressure (say atmospheric pressure for removal of "char" and inorganic products).
- Design enables smaller footprint thermal transformation or gasification and liquefaction systems that are more user friendly.
- Design enables the more effective use of mesh, powder, and nano-sized catalyst materials to accelerate the transformation of gaseous hydrocarbons into liquidous hydrocarbons.
- Design enables the use of sequestering agents to in the liquid heat transfer medium to sequester of amalgamate harmful components occurring in the feedstock material, such as elemental or compounds of chlorine, sulphur, or mercury.

All of these features are important to create an improved means of thermal decomposition of organic feedstocks. This is especially to case in with today's challenge to decrease greenhouse gas emissions by increasing the use of renewable biomass for our energy needs.

It will be clearly understood that, if a prior art publication is referred to herein, this reference does not constitute an admission that the publication forms part of the common general knowledge in the art in the United States or in any other country.

SUMMARY OF THE INVENTION

The present invention is directed to a device and method for thermal decomposition of organic materials which may at least partially overcome at least one of the abovementioned disadvantages or provide the consumer with a useful or commercial choice, and benefit the environment.

With the foregoing in view, the present invention in one form, resides broadly in a series of vessels containing a liquid phase material made up of a molten metal, salt, or other chemistry, of varying temperatures and pressures arranged to gasify, liquefy, cause chemical or physical reactions, and separation of the organic and inorganic components of a feedstock. Each vessel has submerged lower inlet and submerged or semi-submerged outlet for the feedstock flow-through, and outlets for the products of gas, liquids, or solids that separate out by either mechanical or gravitational means. A first vessel contains a liquid phase bath with at least one inlet occurring below the level of the liquid phase bath and a submerged or semi-submerged outlet connecting to the inlet of a second vessel, where the inlet mechanism does not allow the inclusion of air into the vessel. The inlet to the second vessel occurs below the level of a liquid phase bath that is at a higher temperature than that of the first vessel. The inlet to the third vessel occurs below the level of a liquid phase bath that is at a higher temperature than that of the second vessel. The inlet to the fourth vessel occurs below the level of a liquid phase bath that is at a higher temperature than that of the third vessel. And so on and so forth. In each stage of this series a multitude of reactions can occur, including vaporization, pyrolysis, liquefaction, gasification, combustion or chemical reactions, where the products of these reactions can be separated out of each independent vessel.

In this one example there are four vessels. The first vessel operates with a liquid phase bath at about 250-300 degrees F. and conducts a drying operation to remove excess moisture from the feedstock material by creating steam. The second vessel operates with the liquid phase bath at about 300-600 degrees F. creating a "top layer" capture area where the of lighter weight liquefied organic matter, namely oils, liquefied fats, and liquefied thermoplastics that have been separated from the organic feedstock rise up to the top for separation and collection. The third vessel operates with a liquid phase bath at about 600-900 degrees F. causing thermal decomposition and gasification of more volatile organic matter in the feedstock into a syngas product of that temperature range. The remaining non-gasified organic matter would then go into a fourth vessel with a liquid phase bath at about 900-1500 degrees F. causing further thermal decomposition and gasification in to a syngas product of that temperature range.

Oxygen, steam, or syngas can be injected into any of the vessels to obtain the desirable results of ensuing chemical or physical reactions or heat transfer. For example, steam could be injected into the fourth vessel to react with the carbon to form carbon monoxide and process heat.

The process heat from any of the vessels, either being endothermic or exothermic, can be transferred with a network of piping and pumps transferring the molten liquid phase between the different vessels to distribute heating or cooling as necessary to optimized the desired physical and chemical reactions.

The syngas products from the third and fourth vessels could be injected into the bottom of the second lower temperature vessel with the use of proper catalysts to cause liquefaction of the syngas and thermal input for liquefying the incoming feedstock.

Excess carbon (or char) that floats on the top of the liquid phase bath in the fourth vessel could be separated out and used for either later combustion, sale as a commercial product, or storage in an effort of "carbon sequestration" which is the aim of many environmentalists.

The above-described series could include a larger number of vessels at both different pressures and temperatures. A system of vessels and interconnecting piping would be designed for each particular feedstock. For example, for municipal waste feedstocks a large and complex system with multiple interconnected vessels would be used. Whereas if the feedstock is one specific composition, say peach pits, then possibly only two vessels would be necessary, including oil and fat extraction and gasification.

For the liquefaction and gasification of coal, in one preferred embodiment, a specific vessel with the correct pressure and temperature would be designed for sulphur removal. In this embodiment, the sulphur compounds from the pulverized coal would form and amalgam or compound with the liquid phase media to form at the top of the liquid phase media, being of lower density than the liquid metal, then be separated. The sulphur compounds formed could be processed in electrochemical cells for separation and isolation, or if anodic materials are formed, can be used to produce direct current electricity.

BRIEF DESCRIPTION OF THE DRAWINGS

Various embodiments of the invention will be described with reference to the following drawings, in which.

DETAILED DESCRIPTION OF THE PREFERRED EMBODIMENT

With reference to FIG. 1 through 5, the present invention will be explained.

Figure 1:
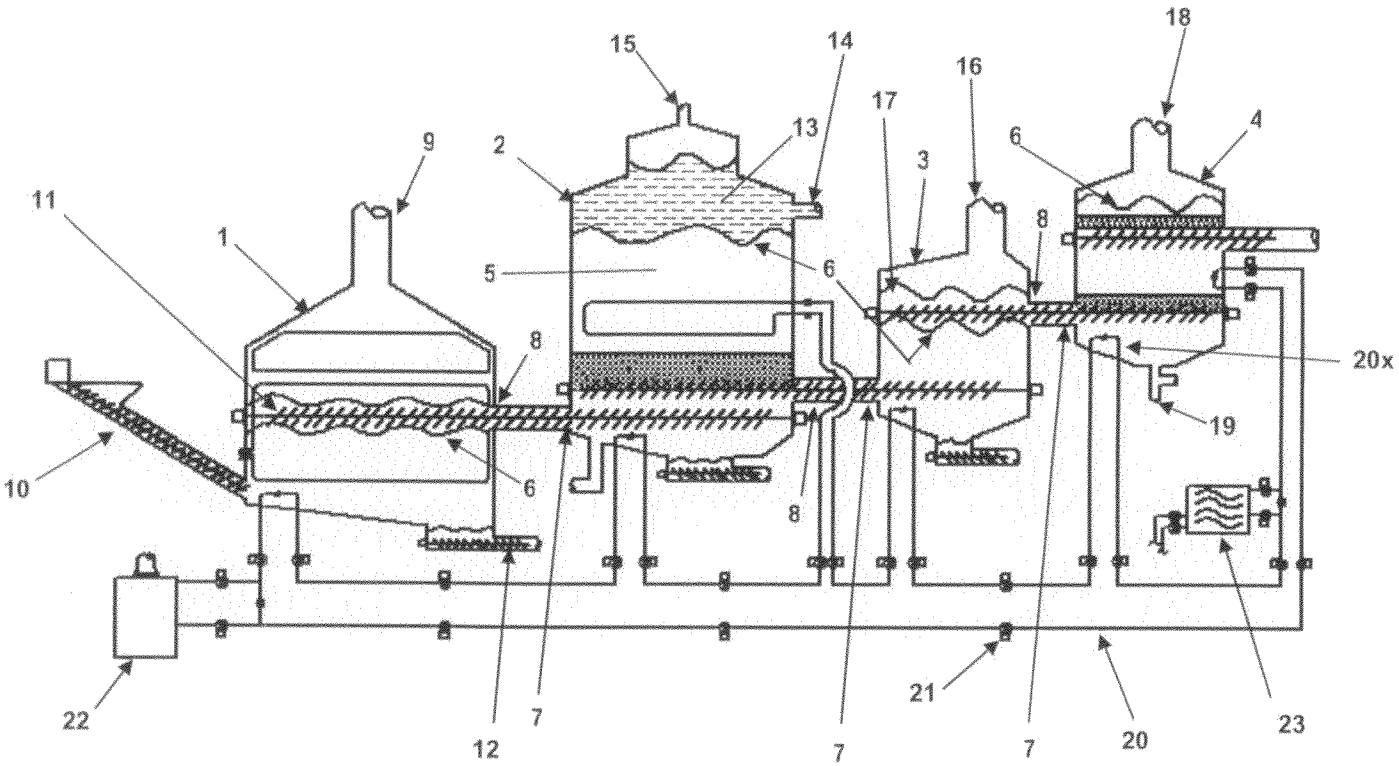
FIG. 1 shows one embodiment of an arrangement of four reaction vessels including a first lower temperature reactor for drying, a second reactor for medium temperature liquefaction, a third reactor for higher temperature gasification of the feedstock material, and a fourth reactor for highest temperature gasification or chemical reactions. Each vessel has an input and output for the feedstock material, appurtenances for the reaction products, and inlets and outlets for heat transfer.

FIG. 1 shows one embodiment of an arrangement of four reaction vessels including a first reactor (1) lower temperature reactor for drying or gasification, a second reactor (2) for medium temperature liquefaction, a third reactor (3) for higher temperature gasification of the feedstock material, and a fourth (4) reactor for highest temperature gasification or chemical reactions.

Each reactor vessel contains a molten liquid phase material (5) of an elevated temperature at a specific liquid phase level (6). The molten liquid phase material (5) is generally non-reactive to the feedstock material and can be a molten metal such as lead, tin, antimony, or bismuth, or a salt compound such as a eutectic salt. Each vessel has at least one submerged feedstock input (7). Each vessel has at least one feedstock output (8) that may be submerged below or in the immediate vicinity of the liquid phase level (6). Each vessel has at least one gas phase outlet (9).

As shown in FIG. 1 there is a throughput of a feedstock material beginning in a feed hopper mechanism (10) that feeds material into the submerged feedstock input (7) of the first reactor (1). In this embodiment the purpose of the first reactor (1) is to remove excess moisture from the feedstock. The liquid phase material (5) in the first reactor (1) is at a sufficient temperature and with a high degree of heat transfer capability to vaporize a determined amount of the moisture in the feedstock material without causing any thermal transformation of the feedstock material. The water vapor is rises and is vented out of the reactor (1) though a series of baffles (shown in FIG. 2) and exits through a gas phase outlet (9). The water vapour steam can be vented, used for power or heat transfer, or injected into another reaction vessel for the desired chemical or thermal reactions. The solid components of the organic feedstock float to the top of the liquid phase level (6) and are collected and transferred out through the feedstock outlet (8) by an auger (11) or some other mechanism. Solid debris that are denser than the liquid phase material (5), such as ferrous and nonferrous metals, sink to the bottom of the first reactor (1) where they are collected and transferred out through a lower outlet (12) by an auger (11) or some other mechanism. It is here noted that this first vessel could be operated at a sufficiently higher temperature to cause pyrolysis of the organic feedstock material.

As shown in FIG. 1, after the feedstock material exits the outlet (8) of the first reactor (1) it enters the submerged inlet (7) of the second reactor (2). The liquid phase material (5) of the second reactor (2) is at a predetermined temperature and pressure high enough to cause oils, fats, thermoplastics, and whatever predetermined components of the feedstock material to be extracted from the feedstock material and to occur in liquid form, and because of their lower density, to rise up and collect in a liquid product zone (13) and to float on the surface above the liquid phase material (5) above the liquid phase level (6). The liquid product zone (13) can then be tapped off from a liquid product access port (14). Volatile gas products above the liquid product zone can be vented off and either flashed, recycled, or condensed by way of a gas vent (15) at the top of the second reactor (2).

After the feedstock material has been extracted of the oil, fats, and thermoplastics it exits the second reactor (2) through a feedstock outlet (8) by an auger (11) or some other mechanism. Prior to exiting various methods can be used to complement and supplement the reactions that occur in the second reactor (2). Various catalysts can be used to cause and accelerate the liquefaction process. For example, activated metallic mesh screen catalysts can by used to accelerate the liquefaction process, syngas from upstream processes can be injected into a port (15*x*) the bottom of the second reactor (2) and liquefied by reaction with components of the feedstock and catalysts, also, thermal gradients that occur in the rising column can cause a sort of condensation of lower molecular weight components of the syngas into heavier molecular weight and longer chain molecules of gels and liquids. More detail on these reactions and other details are described in FIG. 3.

Solid debris that are denser than the liquid phase material (5), such as ferrous and nonferrous metals, sink to the bottom of the second reactor (2) where they are collected and transferred out through a lower outlet (12) by an auger (11) or some other mechanism.

As shown in FIG. 1, after the feedstock material exits the outlet (8) of the second reactor (2) it enters the submerged inlet (7) of the third reactor (3). The liquid phase material (5) of the third reactor (3) is at a predetermined temperature to cause thermal decomposition and gasification of the remaining feedstock. In this embodiment, the remaining feedstock is thermally transformed into syngas and carbon char. The syngas rises though a series of baffles (shown in FIG. 4) and is extracted out of the top collection vent (16) at the top of the third reactor (3). Because of its lower density the carbon char rises up and collects in a char collection zone (17) and floats on the surface above the liquid phase material (5) above the liquid phase level (6). The solid char components of the organic feedstock are collected and transferred out through the feedstock outlet (8) by an auger (11) or some other mechanism. Solid debris that are denser than the liquid phase material (5), such as ferrous and nonferrous metals, sink to the bottom of the third reactor (3) where they are collected and transferred out through a lower outlet (12) by an auger (11) or some other mechanism.

As shown in FIG. 1, after the feedstock material exits the outlet (8) of the third reactor (3) it enters the submerged inlet (7) of the fourth reactor (4). The liquid phase material (5) of the fourth reactor (4) is at a predetermined temperature and pressure to cause thermal, chemical, and physical reactions to occur with the char material, including further gasification or combustion. Many options exist to cause desirable reactions to occur. One reaction could be the injection of steam at a steam injection point (19) to react with the char to form thermal output and further gasification of the char into carbon monoxide and heat. These reactions can be caused or accelerated with the addition of catalysts, as further described in FIG. 5. The gases that are produced by the fourth reactor (4) rise and are extracted out top collection vent (18) at the top of the fourth reactor (4). As an option for any remaining char that rises up and collects and floats on the surface above the liquid phase material (5) above the liquid phase level (6) an auger (11) or some other mechanism can be used to transfer material out through the feedstock outlet (8) for collection or processing.

Also shown in FIG. 1 is a series of fluid and heat transfer conduits (20). The fluid and heat transfer conduits (20) keep the proper liquid phase level (6) in each of the reaction vessels (1, 2, 3, 4), and are used to transfer heat into or out of each of the reaction vessels as required. For example, the first reaction vessel (1) is highly endothermic and requires thermal energy, where the fourth reaction vessel (4) can be highly exothermic, and by means of the fluid and heat transfer conduits (20) can supply the necessary thermal energy. The fluid and heat transfer conduits (20) can circulate the liquid phase material (5) between vessels by either pressure gradients or pumps and valve networks (21).

Thermal energy can be added or removed to any of the reaction vessels (1, 2, 3, 4) at any point, either by direct firing of burner elements, electric elements, or remote heating sources. FIG. 1 shows a furnace (22) that imparts heat to the liquid phase material (5) flowing through the fluid and heat transfer conduits (20). Also shown is a heat transfer system (23) that removes heat from the liquid phase material (5) flowing through the fluid and heat transfer conduits (20). Heat can be transferred to or from any vessel by means of heat transfer coil (20*x*) located in each vessel. In some cases involving liquefaction of carbonaceous gasses it is desirable to have thermal gradients within the reactor vessel (2) column achieved by this use of centrally mounted heat transfer coils (31) systems within the reactor vessel (2).

Figure 2:
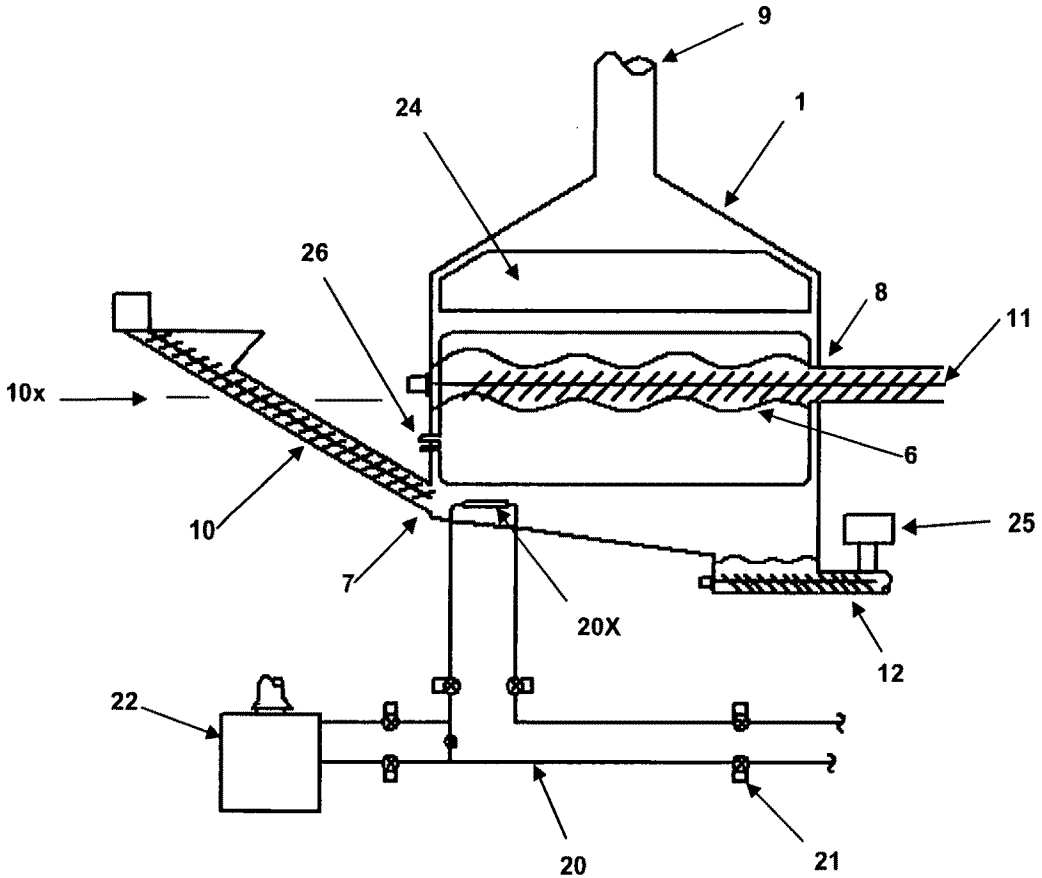
FIG. 2 shows a more detailed description of one embodiment a reactor for drying or gasification or pyrolysis.

FIG. 2 shows a more detailed view of the first reaction vessel (1). A feedstock material is fed into the feed hopper mechanism (10) that feeds material into the submerged feedstock input (7) of the first reactor (1). Depending on the application the liquid phase material (5) in the first reactor (1) could be at a temperature that is high enough to cause thermal decomposition or gasification by pyrolysis (formation of syngas) of a organic feedstock, say up to 1,200 to 1,800 degrees F., or at just enough temperature to vaporize a determined amount of the moisture from a wet feedstock material without causing any thermal transformation of the feedstock material. The syngas or water vapor rises and is vented out of the reactor (1) though a series of baffles (24) that are designed to direct the violently forming gases away from the remaining solid components of the feedstock, and exits through a gas phase outlet (9). The solid components of the organic feedstock float to the top of the liquid phase level (6) and are collected and transferred out through the feedstock outlet (8) by an auger (11) or some other mechanism.

Solid debris that are denser than the liquid phase material (5), such as ferrous and nonferrous metals, sink to the bottom of the first reactor (1) where they are collected and transferred out through a lower outlet (12) by an auger (11) or some other mechanism. In some cases it is beneficial use a heat transfer system (25) to quench a portion of the lower outlet (12) to from a sort of solid extrudable plug to extract solid materials from bottom of the reactor vessel.

Heat can be added to or removed from the reactor vessel by means of direct firing onto the walls of the vessel, electric elements, or a fluid and heat transfer conduit (20), and pump and valve networks (21), and furnace (22). Heat transfer to or from the reaction vessel (1) by means of an internal heat transfer coil or combustion vessel (26) that can either circulate heat transfer fluid, or be direct fired similar to a deep fat fryer in a commercial kitchen.

Figure 3:
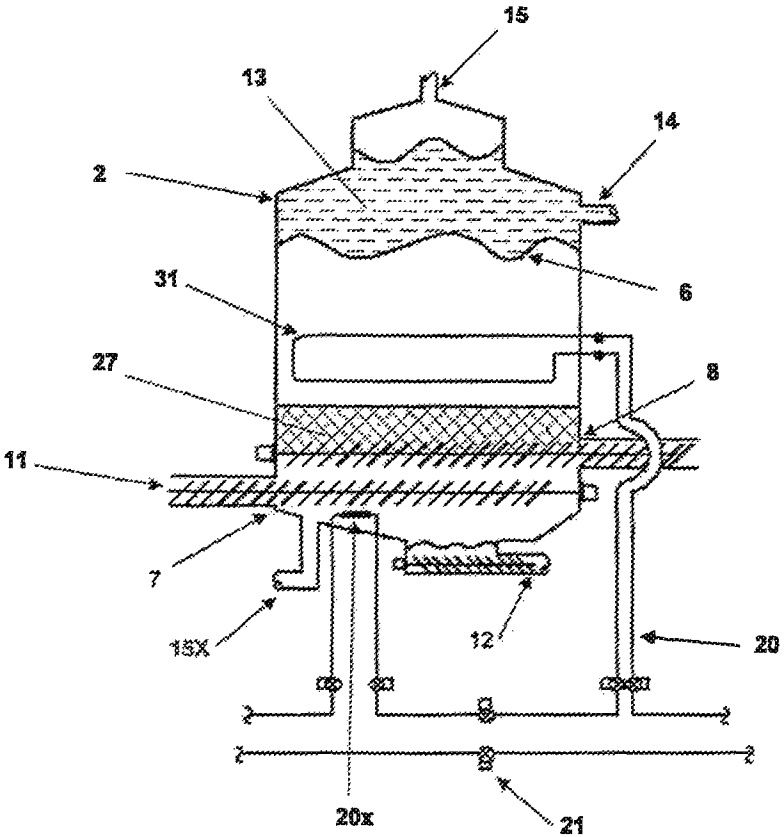
FIG. 3 shows a more detailed description one embodiment a reactor for separation and liquefaction of feedstock materials.

FIG. 3 show a more detailed view of the second reactor (2). The liquid phase material (5) of the second reactor (2) is at a predetermined temperature and pressure high enough to cause oils, fats, thermoplastics, and whatever predetermined components of the feedstock material to be extracted from the feedstock material and to occur in liquid form, and because of their lower density, to rise up and collect in a liquid product zone (13) and to float on the surface above the liquid phase material (5) above the liquid phase level (6). The liquid product zone (13) can then be tapped off from a liquid product access port (14). Volatile gas products above the liquid product zone can be vented off and either flashed, recycled, or condensed by way of a gas vent (15) at the top of the second reactor (2).

When the feedstock material enters the second reaction vessel (2) shown in FIG. 3 various methods can be used to complement and supplement the reactions that occur. Various catalysts can be used to cause and accelerate the liquefaction process. For example, activated metallic mesh screen catalysts can be used to accelerate the liquefaction process. Catalysts in powdered form, including nano-sized materials, can be blended into the liquid phase heat transfer medium. Catalyst materials of iron, cobalt, platinum, and nickel are some examples. Syngas from downstream gasification processes can be injected into a port (15*x*) the bottom of the second reactor (2) and liquefied by reaction with components of the feedstock and catalysts. Also, thermal gradients can be made to occur with heat transfer coils (31) to create lower temperature zones toward the top of the column that cause a sort of condensation of lower molecular weight components of the syngas into heavier molecular weight and longer chain molecules of gels and liquids. A perforated mesh (27) with appropriate catalysts can be used to blend and mix the feedstock and additives together to achieve the desired liquefaction reactions.

Solid debris that are denser than the liquid phase material (5), such as ferrous and nonferrous metals, sink to the bottom of the second reactor (2) where they are collected and transferred out through a lower outlet (12) by an auger (11) or some other mechanism.

Heat can be added to or removed from the reactor vessel by means of direct firing onto the walls of the vessel, electric elements, or a fluid and heat transfer conduit (20), and pump and valve networks (21), and furnaces and recycling waste heat.

Figure 4:
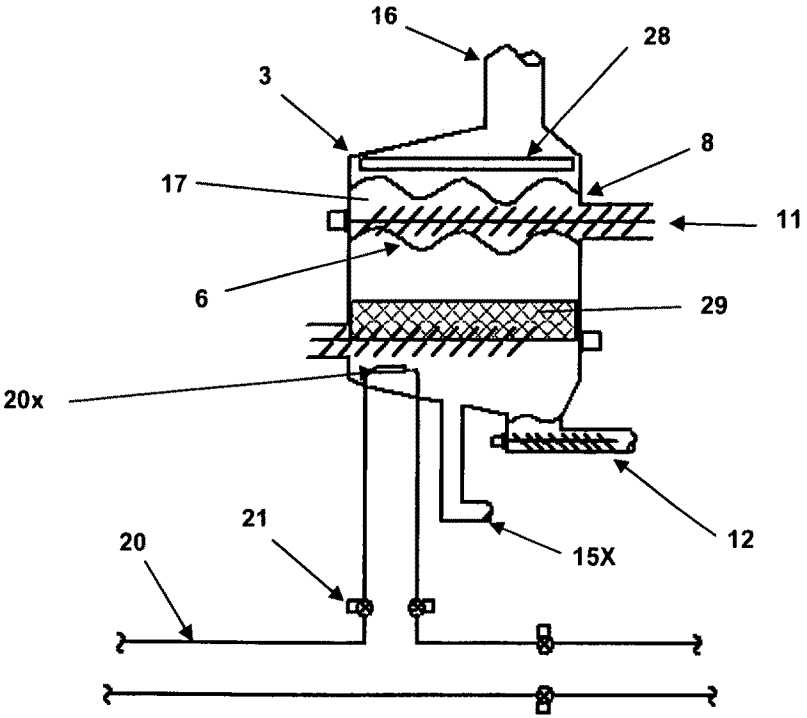
FIG. 4 shows a more detailed description one embodiment a reactor for gasification of a feedstock.

FIG. 4 shows a more detailed description of the third reaction vessel (3). The liquid phase material (5) of the third reactor (3) is at a predetermined temperature to cause thermal decomposition and gasification of the remaining feedstock. In this embodiment, the remaining feedstock is thermally transformed into syngas and carbon char. The syngas rises though a series of baffles (28) and is extracted out of the top collection vent (16) at the top of the third reactor (3). Because of its lower density the carbon char rises up and collects in a char collection zone (17) and floats on the surface above the liquid phase material (5) above the liquid phase level (6). As an option, coarse screen mesh grinder (29) can be incorporated near the lower inlet of the third reaction vessel to assist in the final gasification process. The solid char components of the organic feedstock are collected and transferred out through the feedstock outlet (8) by an auger (11) or some other mechanism. Solid debris that are denser than the liquid phase material (5), such as ferrous and nonferrous metals, sink to the bottom of the third reactor (3) where they are collected and transferred out through a lower outlet (12) by an auger (11) or some other mechanism.

Similar to that in FIG. 3, FIG. 4 shows a port (15*x*) where syngas or other additives can be injected near the bottom of the second reactor (2) and to cause and accelerate liquefied by reaction with components of the feedstock and catalysts.

Heat can be added to or removed from the reactor vessel by means of direct firing onto the walls of the vessel, electric elements, or a fluid and heat transfer conduit (20), and pump and valve networks (21), and furnaces and recycling waste heat.

Figure 5:
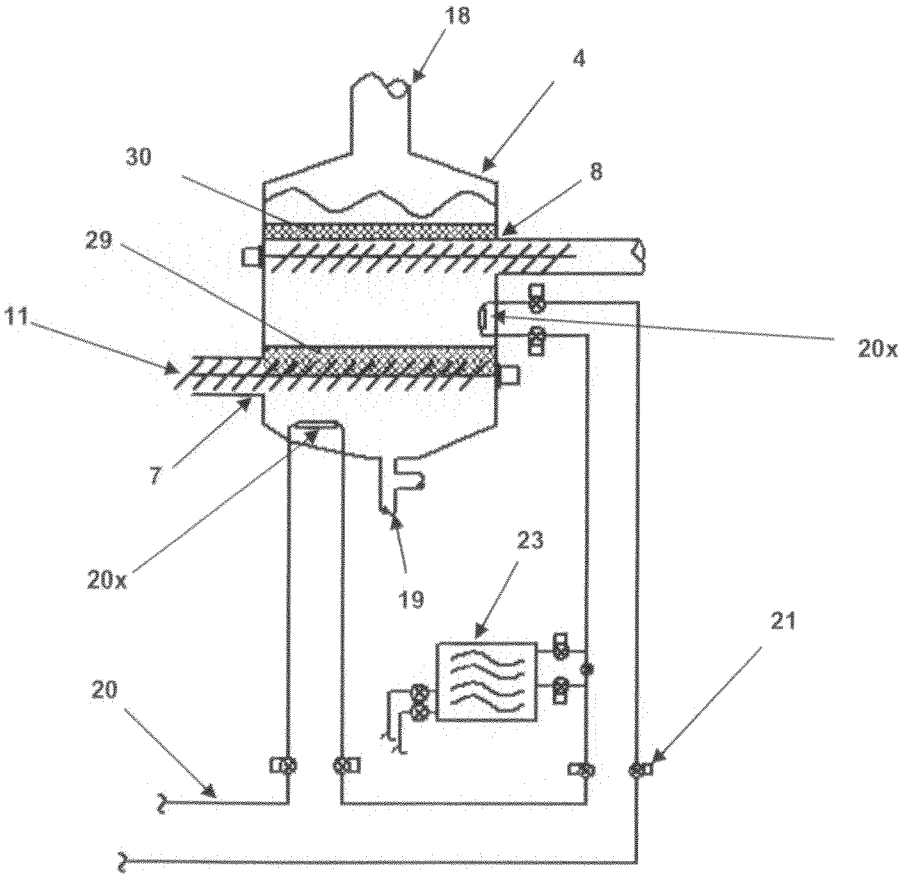
FIG. 5 shows a more detailed description one embodiment a reactor for gasification of a feedstock with additional chemical reactions such as combustion . . .

FIG. 5 shows more detail of the fourth reactor (4). The liquid phase material (5) of the fourth reactor (4) is at a predetermined temperature and pressure to cause thermal, chemical, and physical reactions to occur with the char material, including further gasification or combustion. Many options exist to cause desirable reactions to occur, including a coarse screen mesh grinder (29) that can be incorporated near the lower inlet of the third reaction vessel to assist in the chemical reactions of the gasification process. Steam or other additives can be injected at an injection point (19) to react with the char to cause thermal, chemical, and physical reactions to occur with the char material. The gases that are produced by the fourth reactor (4) rise and are extracted out top collection vent (18) at the top of the fourth reactor (4). An optional secondary mesh component (30) can be installed at the liquid phase level (6) to cause further reaction or facilitate removal of excess char. This option could include an auger (11) or some other mechanism can be used to transfer material out through the feedstock outlet (8) for collection or processing. Heat can be added to or removed from the reactor vessel by means of direct firing onto the walls of the vessel, electric elements, or a fluid and heat transfer conduit (20), and pump and valve networks (21), and furnaces and recycling waste heat.

It should be noted that the arrangement of the four reaction vessels (1, 2, 3, 4) is only for illustration purposes and the arrangement of these liquid phase processes thermal processes can be in any order, quantities, permutations, or combinations. For example for processing used tires, electronics, or coal into syngas, char, and liquid hydrocarbons, no drying process would be required, therefore and only the reaction vessels described here as second and or third may be required. For processing whole olives into pressed oil products only, possibly only the reaction vessels described here as second may be all that is required.

The above describes the general operation of the liquid phase processing system. Unique to the present invention is the use of a molten liquid bath to thermally transform organic materials at different temperatures and the use gravitational and mechanical separation.

Some benefits include

- "Fractional" separation arrangement where the process can be taken from lower temperature (say 250 Degrees F., for drying wet organic feedstocks and steam production), to medium temperatures (say 500-900 degrees F., for separation of naturally occurring oils and fats), to higher temperatures (say 900-1800 degrees F., for gasification of organic matter into "syngas" and production of "char"), all within a single reaction vessel.
- Lower temperature process increases safety aspects of process
- Lower temperature process requires less expensive materials and lessons requirements for insulating materials.
- "Fractional" separation arrangement where the process can be taken through varying temperatures, say from lower temperatures (say 250 degrees F. for separation of moisture from wet organic feedstocks and stream production) to higher temperatures (say 1,800 degrees F. for development of "char" and inorganic products).
- "Fractional" separation arrangement where the process can be taken through varying pressures, say from higher pressures (say 150 psi for separation and processing of moisture from wet organic feedstocks for steam production) to lower pressure (say atmospheric pressure for removal of "char" and inorganic products).

Design enables smaller footprint thermal transformation or gasification and liquefaction systems that are more user friendly.

Design enables the more effective use of mesh, powder, and nano-sized catalyst materials to accelerate the transformation of gaseous hydrocarbons into liquidous hydrocarbons.

Design enables the use of sequestering agents to in the liquid heat transfer medium to sequester of amalgamate harmful components occurring in the feedstock material, such as elemental or compounds of chlorine, sulphur, or mercury.

In the present specification and claims (if any), the word "comprising" and its derivatives including "comprises" and "comprise" include each of the stated integers but does not exclude the inclusion of one or more further integers.

Reference throughout this specification to "one embodiment" or "an embodiment" means that a particular feature, structure, or characteristic described in connection with the embodiment is included in at least one embodiment of the present invention. Thus, the appearance of the phrases "in one embodiment" or "in an embodiment" in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

What is claimed is:

1. A thermal decomposition device provided with a vessel containing a liquid phase heat transfer media with at least one inlet for supplying an organic feedstock material and a series of at least two outlets with separate heat exchangers located between said inlet and outlets, and further including a first catalyst material in the form of a permeable mesh included between said inlet and outlets to accelerate liquidfication of gaseous hydrocarbons, wherein said separate heat exchangers adds add or remove heat to cause thermal gradients between said inlet and outlets.

2. The thermal decomposition device provided with a vessel according to claim 1, wherein said liquid phase heat transfer media is a molten salt.

3. The thermal decomposition device provided with a vessel according to claim 1, wherein said liquid phase heat transfer media is a molten metal.

4. The thermal decomposition device provided with a vessel according to claim 1 wherein said first catalyst material is an elemental or compound form of iron, cobalt, nickel, or platinum.

5. The thermal decomposition device provided with a vessel according to claim 1, wherein said liquid phase heat transfer media has a second catalyst material mixed into the liquid phase heat transfer media to accelerate liquefaction of gaseous hydrocarbons.

6. The thermal decomposition device provided with a vessel according to claim 5, wherein said second catalyst material is an elemental or compound form of iron, cobalt, nickel, or platinum.

7. The thermal decomposition device provided with a vessel according to claim 5, wherein said second catalyst material is in the form of a nanopowder.

8. The thermal decomposition device provided with a vessel according to claim 1, wherein said outlets are placed apart at an incremental distance from each other in order to produce a weight and density determined fractional separation process of gaseous, liquid, or solid phase materials from the liquid phase heat transfer media.

9. The thermal decomposition device provided with a vessel according to claim 1, further including at least one additional vessel, wherein the liquid phase heat transfer media is transferred between the separate vessels by a pump and conduit network, resulting in transfer of heat to and from the separate vessels.

10. The thermal decomposition device provided with a vessel according to claim 9, wherein a heat transfer mechanism is used to add or remove heat to or from the liquid phase heat transfer media at a location remote from said separate vessels.

11. The thermal decomposition device provided with a vessel according to claim 10, wherein the heat is added by a combustible gas type of heater.

12. The thermal decomposition device provided with a vessel according to claim 10, wherein the heat is added by an electric type of heater.

13. The thermal decomposition device provided with a vessel according to claim 10, wherein the heat is removed by a water boiler.

14. The thermal decomposition device provided with a vessel according to claim 10, wherein the heat is removed by a liquid or gas media.

15. The thermal decomposition device provided with a vessel according to claim 1, wherein the liquid phase heat transfer media contains a sequestering agent to remove elemental or compound forms of sulphur, chlorine, or mercury.

16. The thermal decomposition device provided with a vessel according to claim 1, wherein an auger mechanism is used to continuously remove liquid or solid residual products from the vessel outlets.

17. The thermal decomposition device provided with a vessel according to claim 16, wherein said auger includes an outlet portion having a cooling mechanism to solidify the liquidous heat transfer media component of the output stream to affect a sealing function.

18. A thermal decomposition device comprising:

first and second vessels, each of said first and second vessels containing a liquid phase heat transfer media, each of said first and second vessels further including at least one inlet for supplying an organic feed stock material to each of said first and second vessels, each of said first and second vessels further provided with at least two outlets;

separate heat exchangers located between said at least one inlet and said at least two outlets in each of said first and second vessels; and a pump and conduit network including a heat transfer mechanism, said heat transfer mechanism provided at a location remote from said first and second vessels, said pump and conduit network transferring said liquid phase heat transfer media between said first and second vessels resulting in a transfer of heat to and from said first and second vessels.

* * * * *

UNITED STATES PATENT AND TRADEMARK OFFICE

CERTIFICATE OF CORRECTION

PATENT NO. : 8,506,765 B2
APPLICATION NO. : 12/654468
DATED : August 13, 2013
INVENTOR(S) : Roger A. Benham It is certified that error appears in the above-identified patent and that said Letters Patent is hereby corrected as shown below:

In the Claims

Column 9, line 37 cancel the text beginning with "1. A thermal decomposition" to and ending "inlet and outlets", and insert the following claim:

--1. A thermal decomposition device provided with a vessel containing a liquid phase heat transfer media with at least one inlet for supplying an organic feedstock material and a series of at least two outlets with separate heat exchangers located between said inlet and outlets, and further including a first catalyst material in the form of a permeable mesh included between said inlet and outlets to accelerate liquidfication of gaseous hydrocarbons, wherein said separate heat exchangers add or remove heat to cause thermal gradients between said inlet and outlets.--

Signed and Sealed this
Twenty-fourth Day of September, 2013

Teresa Stanek Rea

Teresa Stanek Rea
*Deputy Director of the United States Patent and Trademark Office*